US005488889A

United States Patent [19]

Kang

[11] Patent Number: 5,488,889

[45] Date of Patent: Feb. 6, 1996

[54] ROTARY CUTTING DIE

[75] Inventor: Pierson S. Kang, North Wales, Pa.

[73] Assignee: Xynatech, Inc., Rio Rancho, N.M.

[21] Appl. No.: 124,247

[22] Filed: Sep. 20, 1993

[51] Int. Cl.[6] ..... B26D 3/08; B26F 1/44

[52] U.S. Cl. ..... 83/886; 83/346; 83/669; 83/698.42

[58] Field of Search ..... 83/346, 663, 669, 83/698.41, 698.42, 861, 879, 880, 886, 887; 76/107.1, 107.8; 493/370, 471

[56] References Cited

U.S. PATENT DOCUMENTS

| | | | |
|---|---|---|---|
| 3,257,885 | 6/1966 | Hornung | 83/669 X |
| 3,744,384 | 7/1973 | Jarritt et al. | 76/107.8 X |
| 3,850,059 | 11/1974 | Kang | 83/346 X |
| 3,937,109 | 2/1976 | Korner et al. | 83/669 X |
| 4,393,738 | 7/1983 | Heyden | 83/663 |
| 4,561,355 | 12/1985 | Cuir et al. | 83/698.41 X |

*Primary Examiner*—Eugenia Jones
*Attorney, Agent, or Firm*—Panitch Schwarze Jacobs & Nadel

[57] ABSTRACT

A cutting die for cutting materials is provided. A die sheet having opposing front and back die sheet surfaces is provided. At least one cutting edge defining a die pattern is formed extending outwardly from a portion of the front sheet surface. A spacer abutment extending outwardly from a portion of the back surface of the die sheet is also provided. The spacer abutment is disposed in alignment with the cutting edge. A pressure surface is provided for applying the die sheet to the materials. An abutment surface of the spacer is abutted directly against the carrier surface in order to dispose the cutting edge a predetermined distance from the pressure surface. Cavities formed between adjacent abutments may be filled with an adhesive material in order to secure the cutting die to the pressure surface. The cutting die may be flexible and may be adhesively secured to a cylindrical die carrier.

4 Claims, 3 Drawing Sheets

ROTARY CUTTING DIE

BACKGROUND OF THE INVENTION

The present invention relates to a rotary cutting die and, more particularly, to a method for mounting an etched rotary cutting die upon a rotating cutting cylinder.

Rotary cutting dies of this type are used as presses in the printing and packaging industries for cutting pressure sensitive labels, perforations and openings. They are used for cutting shapes in paper, plastic film and thin metal foil. Pressure sensitive labels, markers, and other similar articles formed by these cutting dies are usually made available in strips or rolls. A plurality of such labels or the like are attached to an elongated backing layer by a pressure sensitive adhesive in these strips or rolls. The pressure sensitive adhesive or gum is permanently adhered to the back of the label while the backing layer is provided with a release coating. Hence, a label having pressure sensitive adhesive separates readily from the backing layer or release layer. The user of these labels merely peels the labels or markers from the backing layer and applies the peeled-off labels or markers as required.

In order to manufacture these labels or markers on a mass production basis a strip comprising a layer of label material, a layer of pressure sensitive adhesive and a backing layer are assembled and passed under the cutting die. The cutting die may have any convenient arrangement or array of patterns thereon in accordance with the shapes desired for the labels. The labels are formed by cutting through the layer of label material adhered to the backing layer. The die also cuts through the adhesive layer beneath the layer of label material. However, the dimensions of the cutting edge, as well as the tolerance of the dimensions, are selected to prevent the die from cutting through the backing layer. In this manner a continuous strip or sheet of labels is maintained.

Prior art cutting dies suitable for preparing these label strips had the undesirable characteristic of tending to crush the label material into the backing layer or release layer, thereby weakening or destroying the latter. This occurred because the label material and backing layer are often made of paper and the edges of the cutting dies had flat lands or faces. The flat faces resulted from the fact that the cutting edges were of such a small size that mechanical techniques for forming them were not feasible, and the edges were therefore prepared by photo etching processes. The photoetching processes known in the prior art tended to produce somewhat flat cutting edges.

Accordingly, there was a need for a method for providing an improved die for cutting labels and the like in such a manner that the crushing effect and resultant weakening of the backing layer caused by the dies of the prior art could be avoided. This problem, as well as other problems of the prior art, was addressed by U.S. Pat. No. 3,850,059, issued to Pierson S. Kang on Nov. 26, 1974. Kang taught a die having a base with a raised cutting edge extending from the base. The lateral extent of the cutting edge defined a pattern for the labels or the like to be cut. The profile or cross section of the cutting edge remote from the base was rounded so that the portions of the cut layer on either side of a cut made by the cutting edge were cammed away from each other. Thus the uncut release layer beneath the cut layers was not crushed. Kang also taught a method for cutting labels or the like with this cutting die.

The die taught by Kang was a flexible die formed by a chemical etching process. The chemical etching of the flexible dies was performed primarily by the use of a photofabrication technique. In this photofabrication technique the metal forming the die was first coated on its front side with a photosensitive resist. The photosensitive resist was exposed to ultraviolet rays through a photographic transparency containing a clear image of the features of the die cutting pattern. Chemically etched flexible dies of this general type became widely used in the prior art because of their accuracy, their reproductibility and the low cost of chemically etched die production. Further contributing to the widespread use of etched dies of this type was the fact that they could be produced easily and quickly.

Flexible cutting dies formed by this type of chemical photoetching process were usually secured magnetically to magnetic cylinders or magnetic rollers. However, these magnetic cylinders were very expensive. Thus, despite the many advantages of chemically etched flexible dies, in some cases their use was limited by the cost of the magnetic cylinders required to secure and bear them during the cutting process.

In order to avoid the expense of the magnetic cylinders, chemically etched flexible dies were sometimes secured to non-magnetic cylinders using an adhesive layer between the die and the non-magnetic cylinder. However, this did not produce tolerances which were acceptable for cutting labels because of the unevenness of the adhesive layer. An unacceptable tolerance in the thickness of the adhesive layer between a cutting edge and the surface of a non-magnetic roller could cause the label to be cut to a depth insufficient to permit convenient peeling from the backing layer. Alternately, it could cause the backing layer to be cut and damaged by the cutting edge of the die.

To solve these and other problems the present invention provides a flexible cutting die and a method for securing such a flexible die to a non-magnetic blank cylinder. The cutting die formed using the method of the present invention has tolerances which are suitable for cutting pressure sensitive labels. Cutting edges for cutting the labels extend outwardly from one surface of the cutting die and spacer abutments, aligned with the cutting edges, extend outwardly from the opposing surface of the cutting die. The spacer abutments are positioned directly against the surface of the blank cylinder in order to position the opposing cutting edge with the required tolerances. The flexible die of the present invention is mounted on the blank non-magnetic cylinder by use of adhesive which is selectively applied to the back side of the die. Prior to applying the adhesive to the back side of the die, when the spacer abutments are formed, die cavities between the abutments are formed to provide confined regions wherein the adhesive may be disposed. Thus, no adhesive is disposed between the cutting edges of the die of the present invention and the surface of blank cylinder.

SUMMARY OF THE INVENTION

Briefly stated, the present invention comprises a cutting die and a method for cutting materials using the cutting die. A die sheet having opposing front and back die sheet surfaces is provided. At least one cutting edge defining a die pattern extends outwardly from a portion of the front sheet surface. A spacer abutment extends outwardly from a portion of the back surface of the die sheet. The spacer abutment is disposed in alignment with the cutting edge. A pressure surface applies the die sheet to the materials. An abutment surface of the spacer is abutted directly against the pressure surface in order to position the cutting edge a predetermined distance from the pressure surface. A cutting force applied to the abutment surface by the pressure surface is transmitted to the cutting edge which is positioned in cutting engagement with the materials in accordance with the spacer abutment.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
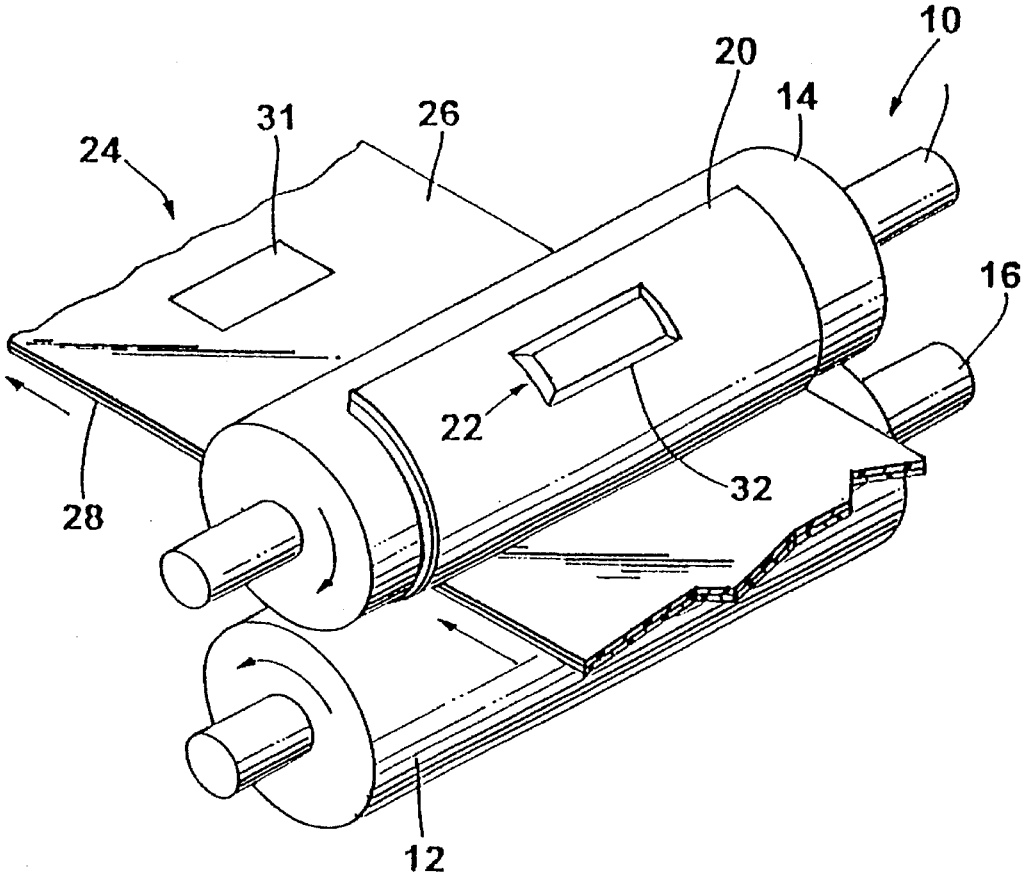
FIG. 1 is a perspective view of a die assembly employing a flexible rotary cutting die used to form labels in accordance with the present invention.

Referring now to the drawings for a detailed description of the invention wherein like numerals refer to like elements throughout the several views, FIG. 1 shows a die assembly generally indicated by the numeral 10 for using the rotary cutting die of the present invention. The die assembly 10 is of a conventional type comprising a hard roll 12 and a die supporting roll or platen 14. The two rolls or platens 12, 14 are mounted for rotation on shafts 16, 18, respectively.

The support roll 14 carries a die plate 20 or die sheet 20 having at least one die pattern 22 defined thereon by the lateral extent of the cutting edges 32. The size of the cutting edge 32 defining the die pattern 22 has been greatly exaggerated for ease of illustration. Also, for purposes of illustration, only one die pattern 22 has been shown on the die plate 20 in FIG. 1. However, it will be apparent that as many patterns of like or different configurations may be placed on die plate 20 as is convenient. A label strip generally indicated by numeral 24 is shown in FIG. 1 as it passes through the nip between the hard roll 12 and the die support roll 14 which bears the die plate 20.

Figure 2:
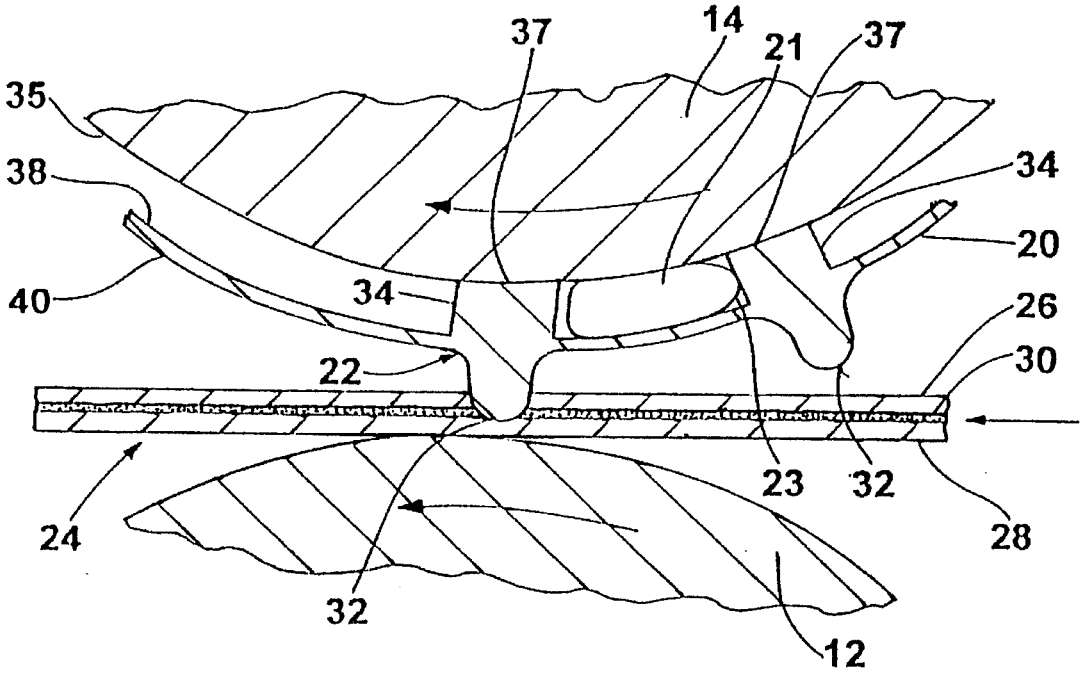
FIG. 2 is an enlarged and fragmented sectional view showing the manner in which the cutting die of the present invention is spaced apart from its roller while it penetrates the layers of material in a label strip.

Referring now to FIG. 2, there is shown an enlarged fragmentary cross-sectional view of a die assembly of the type shown in FIG. 1. FIG. 2 illustrates the cutting engagement of a cutting edge 32 of the die pattern 22 as it penetrates into the label strip assembly 24. As best shown in FIG. 2, the label strip assembly 24 comprises a facing layer 26 of label material, a backing layer or release sheet 28, and a layer of pressure sensitive adhesive 30 sandwiched between the facing and backing layers 26, 28. As shown in FIG. 1., the label strip assembly 24 is moving toward the upper left-hand corner as indicated by the arrows. Thus, the die pattern 22 shown in FIG. 1 has already cut the label 31 from the facing layer 26 of label strip assembly 24 without cutting or crushing the backing layer 28.

The cutting edge 32 of the cutting pattern 22 extends outwardly from the front surface 40 of the die plate 20. Additionally, disposed on the back surface 38 of the die plate 20, a spacer abutment 34 extends outwardly from the back surface 38 of the die plate 20. The spacer abutment 34 is disposed on die plate 20 opposite the cutting edge 32 and in radial alignment with cutting edge 32.

The spacer abutment 34 is provided with an abutment surface 37 which is disposed directly against the pressure surface 35 or pressure surface 35 of the carrier platen 14. Cutting force is applied to the abutment surface 37 of the spacer abutment 34 by the pressure surface 35 of the platen 14 in order to apply force to the label strip assembly 24 and the cutting edge 32. When this cutting force is applied in this manner, the tip of the cutting edge 32 is positioned exactly at a predetermined distance from the carrier surface 35 of the platen 14 by the spacer abutment 34.

The alignment between spacer abutment 34 and cutting edge 32, as they extend outwardly in opposing directions from the surfaces 38, 40 of the die plate 20, should be understood to be an alignment which disposes opposing extensions 32, 34 substantially between the point of carrier surface 35 applying force from platen 14 and the point of label assembly 24 being cut. Because outward extensions 32, 34 or elevations 32, 34, are aligned with each other in this manner they are effective to transmit the cutting force to the point of contact between cutting edge 32 and the label assembly 24 reliably. It will be understood that the carrier surface 35 or pressure surface 35 may include any surface used to apply cutting pressure to abutment surface 37 of spacer abutment 34 and, therefrom, to cutting edge 32. Because the abutment surface 37 of spacer abutment 34 is disposed directly against the pressure surface 35 in this manner the distance between the carrier surface 35 and the label strip 24 may be controlled with very close tolerance. For example, this tolerance may be controlled to approximately 0.0002 inches. This permits the cutting edge 32 to cut reliably through facing layer 26 and the pressure sensitive adhesive 30 without damaging the release sheet 28 with greater reliability.

Adjacent spacer abutments 34 form a die cavity 23 therebetween. Die cavity 23 is also bounded by carrier surface 35 of platen 14 and back surface 38 of die plate 20. An adhesive substance 21 may be disposed within the die cavity 23 in order to adhere the die plate 20 to the carrier surface 35 of the platen 14. The adhesive substance 21 adheres the carrier surface 35 of the platen 14 to the back surface 38 of the die plate 20. However, care should be taken to make certain that the adhesive substance 21 is not disposed between the carrier surface 35 and the abutment surfaces 37 of the spacer abutments 34. Any adhesive substance disposed between the surfaces 35, 37 may alter the total distance between the carrier surface 37 and the tip of the cutting edge 32, thereby degrading the tolerances to which labels may be cut from the label strip assembly 24 using the die cutting system 10 of the present invention.

The blank non-metallic cylinder 14 or carrier cylinder 14 suitable for use with the die of the present invention may be a standard die blank with or without integral shaft 18 commonly known to those skilled in the art. When a cutting operation is completed in accordance with the method of the present invention the adhesively secured flexible die 20 may be removed from the cylinder 14 and the cylinder 14 may be reused. The reusable cylinder 14 may be turned down to a smaller diameter for reuse.

The preferred adhesive substance 21 may be a preformed cut sheet of epoxy coated woven fiber glass cloth which may be fitted into die cavities 23. In an alternate embodiment an accurate syringe-type automatic fluid dispenser may be used to place the correct volume of adhesive substance 21 inside the die cavities 23 etched into the back side of the die. For example, the Automatic Fluid Dispenser, 1000XL, the Timed-Thick Paste Dispenser, 1000D, or the Manual Dispenser, 800L, provided by EFD, East Providence, R.I., 02914, may be used for this purpose. In this embodiment the amount of adhesive substance 21 dispensed may be determined by calculating the volume of the die cavities 23. The adhesive substance 21 need not be applied elsewhere between carrier surface 35 and back surface 38 except within die cavities 23. After adhesive substance 21 is applied a known retaining fixture (not shown) may be used to hold the flexible die 20 in place upon cylinder 14 while the adhesive substance 21 is drying or curing.

Figure 3A:
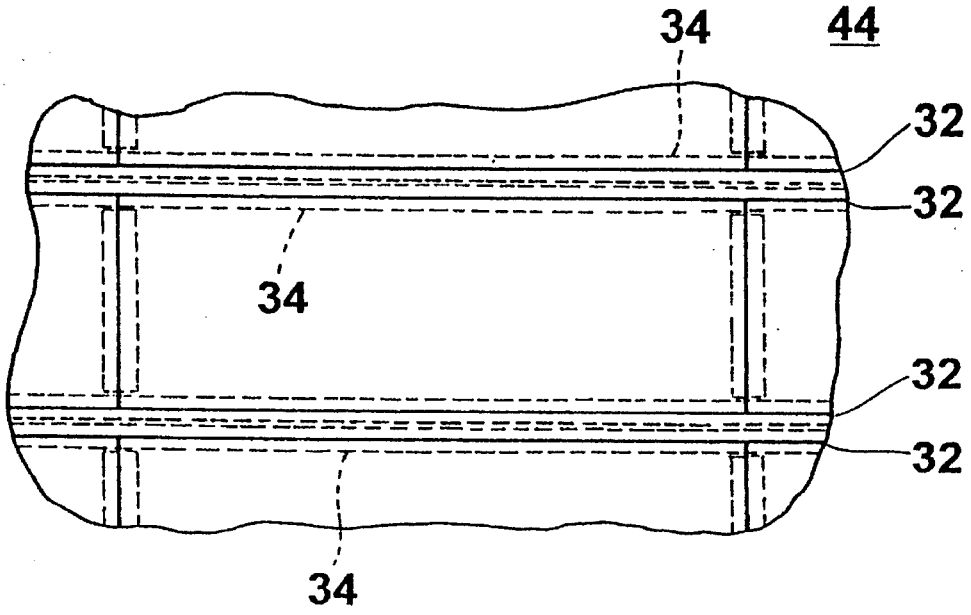
FIGS. 3A and 3B are top and bottom views of a cutting die in accordance with the present invention for forming a plurality of labels.
Figure 3B:
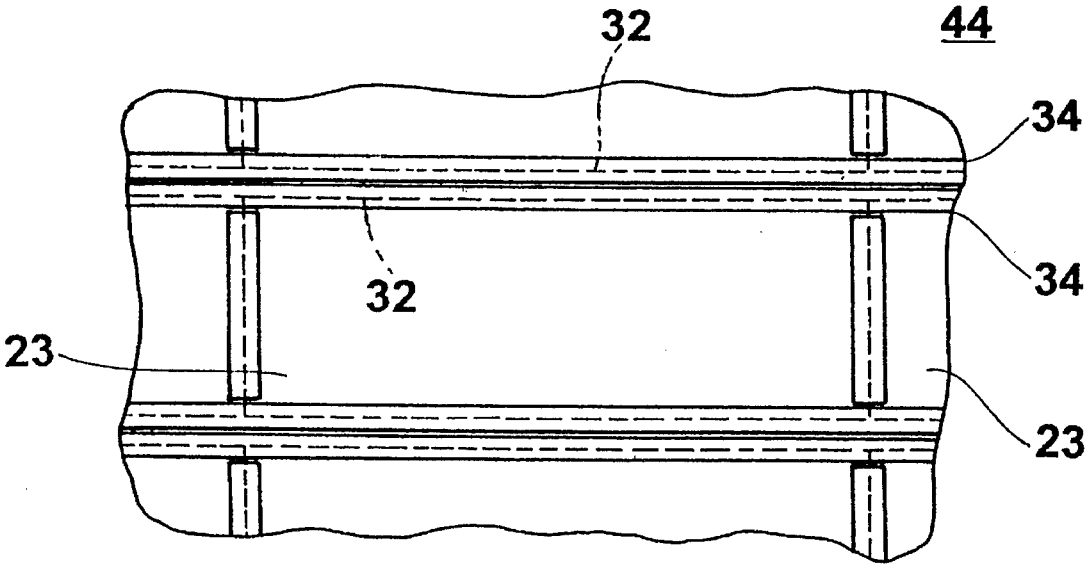

Referring now to FIGS. 3A and 3B, there are shown fragmentary top and bottom views of the die plate 20 of the present invention wherein a plurality of die patterns 22 are defined. FIG. 3A shows a top view of a plurality of cutting edges 32 which extend outwardly from the front surface 40 of the die plate 20 for a predetermined distance required to accurately cut labels from label assembly 24. The outlines of the spacer abutments 34 which extend outwardly in the opposite direction in alignment with the cutting edges 32 are shown in phantom view. The alignment of cutting edges 32 and spacer abutments 34 transmits cutting force from the carrier surface 35 to the cutting edges 32 while positioning the tip of the cutting edges 32 at a predetermined distance from the carrier surface 35 as previously described.

FIG. 3B shows a bottom view of a plurality of the spacer abutments 34 of the die patterns 22 which extend outwardly from the back surface 38. The spacer abutments 34 are disposed opposite their corresponding aligned cutting edges 32. Additionally, a plurality of die cavities 23 formed therebetween are illustrated. The cutting edges 32 are shown in phantom beneath the spacer abutments.

In the preferred embodiment of cutting die plate 20 the width of spacer abutments 34 substantially exceeds the width of cutting edges 32 as shown in FIGS. 3A and 3B. However, it will be understood by those skilled in the art that the relative widths of opposing outward extensions 32, 34 may vary provided that they are effective to provide a stable transmission of force from the pressure surface 35 to the label strip assembly 24 and maintain the predetermined distance between the pressure surface 35 and the tip of the cutting edge 32.

Figure 4:
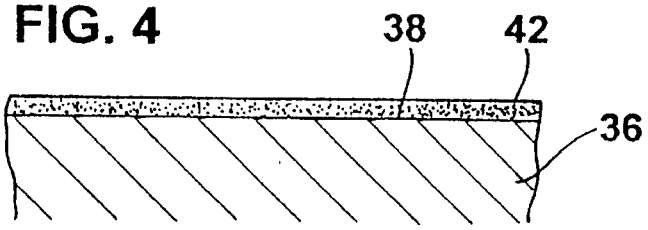
FIGS. 4–8 are enlarged fragmentary cross-sectional views of the cutting die of the present invention in several stages of manufacture.

Details of the forming of the abutment spacers 34 are described with reference to FIGS. 4–8 in connection with the manner in which the cutting die 20 is manufactured. Referring in particular now to FIG. 4, a sheet of metal 36 is provided from which the aforementioned die plate 20 is formed. The sheet of metal 36 may be any suitable metal from which cutting dies are conventionally formed such as hardened high carbon steel or hardened stainless steel. Furthermore, it will be understood that the material of the die sheet 20 may be any other material provided that the aligned extensions 32, 34 may be formed on opposing surfaces thereof. Furthermore, while the material of the die sheet 36 is flexible in the preferred embodiment, it may be formed of a rigid material and mounted on a flat carrier surface or a carrier surface shaped in any other way. Similarly, the metal sheet 36 may be of any convenient size. A die sheet 20 having dimensions of about eighteen by twenty four inches and a thickness of about seventeen mils has been found particularly suitable.

Due to the very small dimensions (on the order of several mils) of the raised spacer abutments 34 of the cutting die 20 photographic etching processes are preferred to mechanical forming techniques employed in the manufacture of such cutting dies. Since these photographic etching processes are well known in the art, the basic process upon which the improvement of the present invention is based will only be described very briefly. It will be understood that any variations on the etching process may be used as will be obvious to one of ordinary skill in the art leading up to the steps of the present invention.

In preparation for coating the sheet of metal 36 with a suitable light sensitive resist layer 42, the sheet of metal 36 is first thoroughly cleaned with an alkaline wash or detergent. Many such washes or detergents are well known in the art. After cleaning, a conversion coating (not shown) may be applied to the back surface 38 of the sheet metal 36. Conversion coatings are well known in the art and are desirable to promote adhesion of a light sensitive photoresist such as resist layer 72 to the sheet of metal 36. A number of suitable conversion coating solutions are well known in the art.

After application of a conversion coating, the layer 42 of light sensitive photoresist is applied to the back surface 38 of the sheet of metal 36. Such light sensitive photoresists are well known in the art and typically comprise a synthetic polymer which cross links or further polymerizes when subjected to ultraviolet light. A number of suitable liquid or dry film light sensitive resists are also well known in the prior art. Preferably, both facing surface 40 and back surface 38 of metal sheet 36 are coated with the light sensitive resist 42. The coating of the facing surface 40 prevents any inadvertent etching of that face of the sheet of metal 36 until process steps required to form cutting edges 32 are performed.

Figure 5:
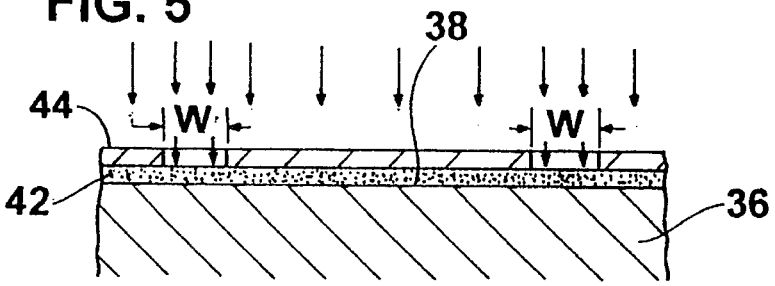

As well known in the art, a pattern negative 44 is next placed over the light sensitive resist 42 on the back surface 38 of the sheet of metal 36 to be etched, as shown in FIG. 5. The pattern negative is placed on the plate surface with registration devices to align it with cutting edge 32. In this manner the desired spacer pattern is transferred to the light sensitive resist 42 by projecting ultraviolet light onto the top of the pattern negative 44. The pattern negative 44 may be prepared by use of a computer controlled photoplotter which applies a light beam onto a polyester photographic film. The light beam generates the spacer abutment patterns on the photographic film. The developed film has opaque background with space abutment patterns in clear lines. However, it will be understood that pattern negative 44 may be provided by any method known in the art without departing from the scope of the present invention.

Where multiple patterns are provided on the same cutting die 20, as shown in FIGS. 3A and 3B, the multiple patterns may be formed on the pattern negative 44 by use of a step and repeat exposure technique. In this technique a portion of the pattern negative 44 is exposed and shifted, another portion is exposed and shifted and so forth.

Figure 6:
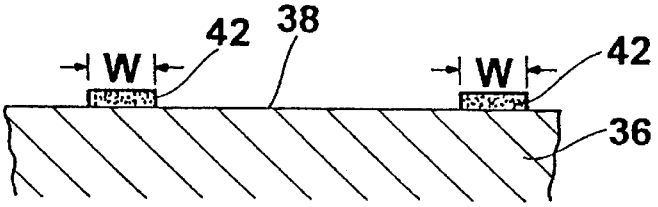

When the pattern negative 44 is placed over light sensitive resist 42, ultraviolet radiation passes through the clear portions of the negative 44 and strikes underlying regions of the resist layer 42. This causes the underlying regions of the photoresist layer 42 to cross link or further polymerize. As a result, when the photoresist layer 42 is subjected to the appropriate developing chemicals, the light sensitive resist remains in those areas where the light has passed through the negative such as etch masks 43. The photoresist layer 42 and is dissolved away in all other areas, as shown in FIG. 6.

In this manner, the pattern from pattern negative 44, which corresponds to the pattern of the spacer abutments 34 to be formed in the sheet of metal 36, is transferred to the light sensitive resist 42. The means and method for removing the remainder of the light sensitive resist 42 by developing are well known in the photographic art and need not be described in detail herein.

Figure 7:
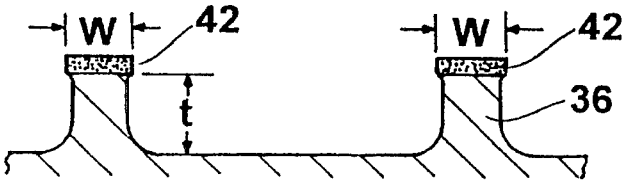
Figure 8:
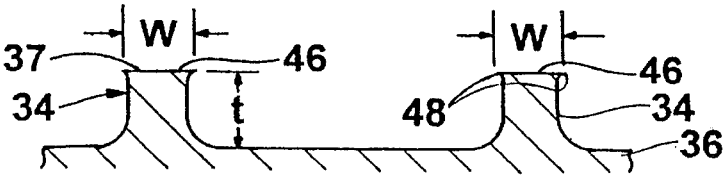

After the developing of the light sensitive resist 42, the sheet of metal 36 is then etched in a conventional manner to form the spacer abutments 34 of die plate 20. The etching may be achieved by any of a number of well known chemical or electrolytic techniques, such as those using nitric acid, ferric chloride, aqua regia, and the like for chemical etching and sodium chloride, hydrochloric acid, sulfuric acid and the like for electrolytic etching. The resulting structure after etching, including spacer abutments 34, is shown in FIG. 7.

In known processes, an etching fluid of suitable composition such as ferric chloride at a temperature of between 120° and 130° F. may be applied to the surface of cutting die 10 by manifold pipes having nozzles therein. The etching material preferably is continuously sprayed upon the exposed metal area of the cutting die plate using the nozzles. The nozzles are continuously oscillated cross-wise of the direction of travel of the plate at high speed, for example, at sixty strokes per minute. The etching distance t shown in FIG. 8 required to form spacer abutments may be between 0.002 inches and 0.003 inches. The width w of abutment surfaces 37 may be between 0.030 inches and 0.100 inches. The etch masks 43 may then be removed from the tops of the unetched portions 34 or spacer abutments 34 which extend outwardly.

Figure 9:
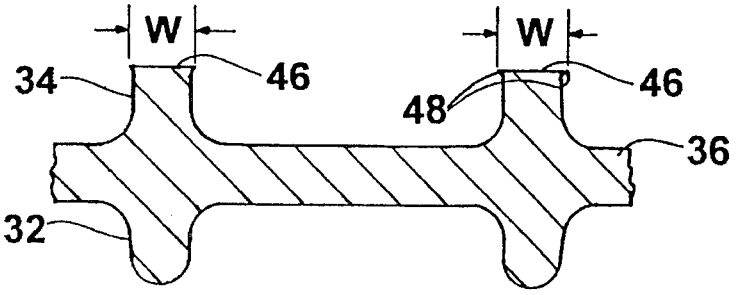
FIG. 9 is an enlarged a cross-sectional view of the cutting die of the present invention wherein the cutting edges are disposed in alignment with the spacer abutments.

Referring now to FIG. 9, there is shown a cross sectional representation of the cutting die of the present invention wherein the cutting edges 32 are disposed in alignment with the spacer abutments 34. Methods which may be used for forming cutting edges 32 upon facing surface 40 of die sheet 20 in this manner, either before or after forming spacer abutments 35, are well known in the art. For example, a method for forming cutting edges 32 is taught in U.S. Pat. No. 3,850,059, issued to Pierson S. Kang on Nov. 26, 1974, which is incorporated by reference herein. Cutting edges 32 formed by the method of Kang and spacer abutments 34 may be seen to be extending outwardly away from each other in opposite directions from the etched surfaces of die sheet 20.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A cutting die for cutting a material, comprising:

a. a die sheet having opposing first and second die sheet surfaces;

b. a pressure surface for applying said die sheet to said material;

c. said die sheet having at least one die pattern having a cutting edge extending outwardly from a portion of said first surface of said die sheet;

d. said second surface of said die sheet including a plurality of outwardly extending spacer abutments, each having an extending abutting surface, said cutting edge, said spacer abutments and said die sheet being of single piece construction;

e. said spacer abutments being disposed in alignment with said cutting edge with said extending abutting surface of said second die sheet surface being applied directly against said pressure surface to dispose said cutting edge a predetermined distance from said pressure surface;

(f) a cavity between said plurality of abutments; and (g) an adhesive substance disposed within said cavity to secure said die sheet to said pressure surface.

2. The cutting die of claim 1, wherein said die sheet is releasably secured to said pressure surface by said adhesive.

3. The cutting edge of claim 1, wherein said die sheet is formed of metal.

4. The cutting edge of claim 1, wherein a die sheet carrier having said pressure surface is non-magnetic.

* * * * *